US006468375B1

(12) United States Patent
Hamblin

(10) Patent No.: US 6,468,375 B1
(45) Date of Patent: Oct. 22, 2002

(54) PACKAGE

(75) Inventor: Geoffrey R. Hamblin, Willoughby (AU)

(73) Assignee: Amcor Limited, South Melbourne (AU)

( * ) Notice: Subject to any disclaimer, the term of this patent is extended or adjusted under 35 U.S.C. 154(b) by 0 days.

(21) Appl. No.: 09/380,175

(22) PCT Filed: Feb. 26, 1998

(86) PCT No.: PCT/AU98/00126

§ 371 (c)(1),
(2), (4) Date: Feb. 9, 2000

(87) PCT Pub. No.: WO98/38106

PCT Pub. Date: Sep. 3, 1998

(30) Foreign Application Priority Data

Feb. 26, 1997 (AU) ..... PO 5295

(51) Int. Cl.[7] ..... B31F 1/00; B65B 63/00; B31B 1/14

(52) U.S. Cl. ..... 156/211; 156/250; 156/257; 493/56; 493/59; 493/356; 493/404; 493/405; 53/429; 53/435; 53/462

(58) Field of Search ..... 428/155, 167, 428/156, 172, 542.8; 156/209, 153, 196, 24, 250, 257; 53/429, 435, 462, 491, 376.2; 493/435, 59, 356, 405, 396, 404

(56) References Cited

U.S. PATENT DOCUMENTS

| | | | | | |
|---|---|---|---|---|---|
| 2,301,618 | A | | 11/1942 | Curtis | |
| 2,468,306 | A | * | 4/1949 | Norden | 229/3.5 |
| 2,481,288 | A | | 9/1949 | Cage | |
| 4,291,807 | A | | 9/1981 | Giordano et al. | |
| 4,380,564 | A | * | 4/1983 | Cancio et al. | 428/167 |
| 4,735,356 | A | | 4/1988 | Engel | |
| 5,054,644 | A | | 10/1991 | Greenslade | |
| 5,750,235 | A | * | 5/1998 | Yoshimasa et al. | 428/182 |

FOREIGN PATENT DOCUMENTS

| | | |
|---|---|---|
| AU | 6428886 | 4/1987 |
| DE | 19629448 | 1/1998 |
| FR | 1132786 | 3/1957 |

* cited by examiner

*Primary Examiner*—Donald J. Loney
(74) *Attorney, Agent, or Firm*—Price, Heneveld, Cooper, DeWitt & Litton

(57) ABSTRACT

A packaging product for forming a package is disclosed. The package product comprises a planar member, with at least one surface (3) of the planar member having a first array of parallel creases (11) and a second array of parallel creases (13) perpendicular to the first array of creases, which creases define cutting lines and/or fold lines for forming the sides and the end flaps of the package.

6 Claims, 1 Drawing Sheet

PACKAGE

Figure 1:
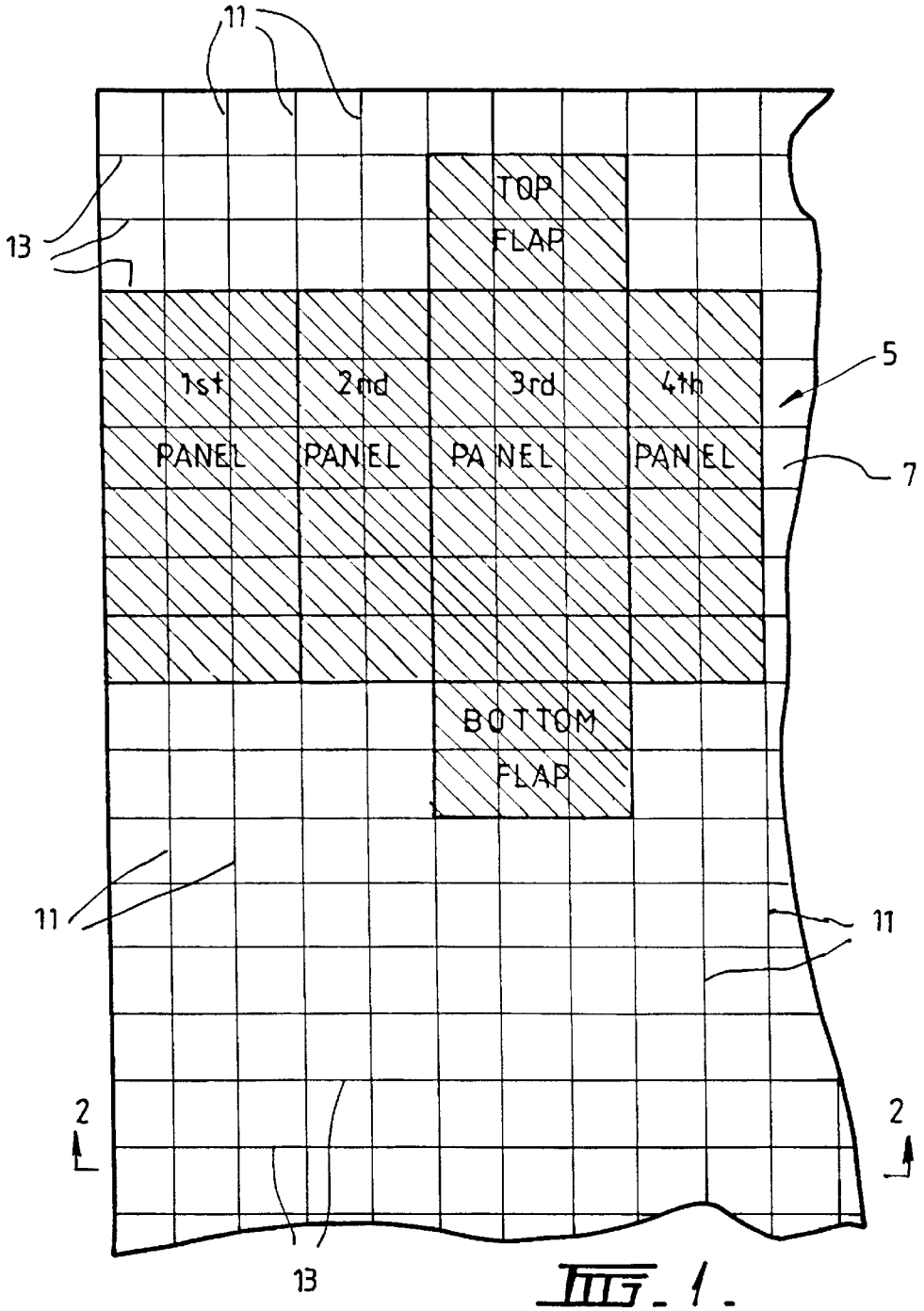

The present invention relates to a package.

The present invention relates particularly to a package product for forming a package.

A disadvantage of conventional packages that are available at retail outlets, such as post offices, is that the packages are of a predetermined size and there is a limited range of different sizes. Therefore, often, an object to be packaged is considerably smaller than the package and this results in a waste in packaging material and, in some situations, damage to the object during transport.

An object of the present invention is to provide a packaging product that can be used to form a range of packages of varying shape and size.

According to the present invention there is provided a packaging product for forming a package, which packaging product comprises a planar member, with at least one surface of the planar member having a first array of parallel creases and a second array of parallel creases perpendicular to the first array of creases, which creases define cutting lines and/or fold lines for forming the sides and the end flaps of the package.

In use, in a situation where the packaging product is too large for the object to be packaged, a package for the object is formed by cutting out a section of the packaging product along creases which match the size of the object and, thereafter, folding the cut-out section along creases to form the sides and end flaps of the package.

Alternatively, in use, in a situation where the packaging product is the required size and shape to form a package for an object to be packaged, the package is formed by selectively folding the packaging product along creases to form the sides and end flaps.

It is preferred that the packaging product be quadrilateral.

It is preferred particularly that the packaging product be rectangular or square.

It is preferred that the spacing between adjacent creases in the first array of creases be 10–30 mm.

It is preferred that the spacing between adjacent creases in the second array of creases be 10–30 mm.

In one embodiment it is preferred that the first and second arrays of creases form a square pattern which defines a plurality of square panels.

In another embodiment it is preferred that the first and second arrays of creases form a rectangular pattern which defines a plurality of rectangular panels.

It is preferred that the planar member be a laminate of a face sheet and a single face corrugated member.

It is preferred particularly that the face sheet be a carton board or a heavy paper material.

It is preferred that the single face corrugated member comprise a laminate of a backing sheet and a corrugated sheet.

It is preferred that the creases be formed in one surface only of the planar member. In use, this surface forms the internal surface of a package.

It is preferred particularly that the creases be formed in the single face corrugated member.

According to the present invention there is provided a package formed from the packaging product described in the above paragraphs.

Figure 2:
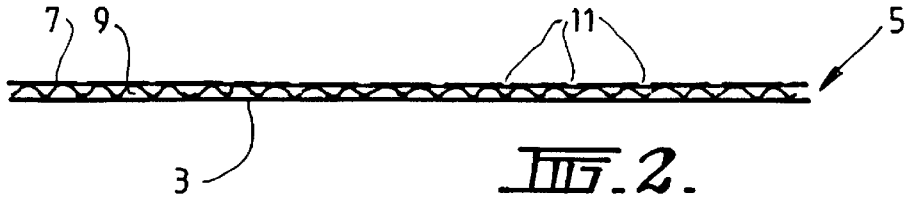

The present invention is described further by way of example with reference to the accompanying drawings, of which:

FIG. 1 is a top plan view of a packaging product in accordance with the present invention; and FIG. 2 is a section along the line 2—2 of FIG. 1.

The packaging product shown in the Figures is suitable for forming a range of packages of different shapes and sizes that have rigid sides and square corners.

The packaging product is suitable particularly, although by no means exclusively, for forming packages for transporting objects by courier or post.

The packaging product comprises a planar member formed as a laminate of:

i. a face sheet 3 (shown in FIG. 2 and the reverse face to that shown in FIG. 1) formed from a carton board; and ii. a corrugated single face member 5 formed from a paper backing sheet 7 and a corrugated paper sheet 9 (FIG. 2 only).

The packaging product further comprises two mutually perpendicular parallel arrays of creases 11, 13 formed in the corrugated single face member 5 which enable the packaging product to be selectively folded, as described by way of example hereinafter, to match the size of an object to be packaged.

In the preferred embodiment of the present invention the creases 11, 13 do not deform the face sheet 3 so that the face sheet 3 presents a smooth surface as the outer surface of a package formed from the packaging product.

With reference to FIG. 1, the arrays of creases 11, 13 are positioned to form a square pattern.

The present invention is not limited to such an arrangement and, by way of example, the arrays of creases 11, 13 may form a rectangular pattern. In some situations a rectangular pattern may be preferable in terms of increasing the flexibility when determining package size and shape.

Typically, the spacing between adjacent creases in each array of creases 11, 13 is 10–30 mm.

The length and width dimensions of the packaging product may be selected as required.

Typically, the packaging product is rectangular in shape and 100 cm long and 60 cm wide.

There are a number of different methods of using the packaging product to form a package for an object. With reference to FIG. 1, one method comprises:

i. placing the object to be packaged on the packaging product and marking the closest creases 11, 13 to the edges of the surface of the object at that time contacting the packaging product, thereby to define a first side panel of the package;

ii. successively repositioning the object on adjacent sections of the packaging product and marking the closest creases 11, 13 to define the second, third, and fourth side panels and the top and bottom flaps of the package;

iii. cutting out the blank for the package along the marked creases 11, 13; and iv. folding the panels and flaps to form the package.

Many modifications may be made to the preferred embodiment of the packaging product of the present invention described above without departing from the spirit and scope of the present invention.

By way of example, whilst the preferred embodiment of the packaging product comprises a laminate of a carton board face sheet and a corrugated single face member formed from paper, it can readily be appreciated that the present invention is not so limited and extends to any suitable construction of the planar member formed from any suitable material(s). In particular, the planar member may be formed from heavier or lighter material depending on the application. Equally, the planar member may have a different structure depending on the application.

What is claimed is:

1. A method of forming a package for an object from a planar sheet of packaging material, the method comprising the steps of:

creating a first array of parallel creases on one surface of the planar sheet;

creating a second array of parallel creases on one surface of the planar sheet, wherein the first array creases and the second array creases are perpendicular;

determining which of the crease lines will define sides of the package most closely approximating the size of the object to be packaged;

cutting along selected ones of the crease lines of the first and the second arrays of creases defining an outer perimeter of a flat package blank for the selected package size; and folding the flat package blank along selected others of the creases to create sides and flaps of the package.

2. The method defined in claim 1, wherein the defining step includes the steps of:

placing the object to be packaged on the planar sheet;

marking the closest creases to the edge of the object, and at that time contacting the planar sheet to define a first side panel of the package; and successively repositioning the object on adjacent sections of the planar sheet and marking the closest creases to define additional desired side panels and end flaps of the package.

3. The method defined in claim 1, including after the determining step, the step of:

marking selected crease lines to define an outer perimeter of a flat package blank.

4. The method defined in claim 3, wherein the defining step includes the steps of:

placing the object to be packaged on the planar sheet;

marking the closest creases to the edge of the object, and at that time contacting the planar sheet to define a first side panel of the package; and successively repositioning the object on adjacent sections of the planar sheet and marking the closest creases to define additional desired side panels and end flaps of the package.

5. The method defined in claim 1, wherein:

the planar sheet of packaging material is comprised of paper having at least one exposed paper surface.

6. The method defined in claim 1, further including:

enclosing the object within the package.

* * * * *